US005577313A

United States Patent [19]

Guido et al.

[11] Patent Number: 5,577,313

[45] Date of Patent: Nov. 26, 1996

[54] METHOD AND APPARATUS FOR JOINING DEFORMABLE SHEET STOCK

[76] Inventors: Anthony Guido, 102 Forest View Rd., Bensenville, Ill. 60106; William Jette, 1330 Saunders Rd., Riverwoods, Ill. 60015

[21] Appl. No.: 374,036

[22] Filed: Jan. 17, 1995

[51] Int. Cl.[6] ..... B23P 11/00

[52] U.S. Cl. ..... 29/432.2; 29/509; 29/521; 29/796; 29/DIG. 11; 29/243.529; 72/197

[58] Field of Search ..... 29/432.1, 432.2, 29/509, 515, 521, 796, 283.5, 276.11, 243.5, 243.17, 243–524; 403/DIG. 11, 375, 285; 72/197

[56] References Cited

U.S. PATENT DOCUMENTS

| | | | |
|---|---|---|---|
| 1,534,141 | 4/1925 | Roesen . | |
| 1,649,363 | 11/1927 | Parsons . | |
| 1,928,134 | 9/1933 | Newhouse . | |
| 2,101,457 | 12/1937 | Rosenmund . | |
| 2,211,285 | 8/1940 | Miller . | |
| 2,254,558 | 9/1941 | Williams . | |
| 2,333,966 | 11/1943 | Weiss . | |
| 2,575,481 | 11/1951 | Anderson . | |
| 2,586,479 | 2/1952 | Pettorossi . | |
| 2,671,361 | 3/1954 | Sandberg . | |
| 2,688,890 | 9/1954 | Williams . | |
| 2,818,568 | 1/1958 | Turrall et al. | 29/432.2 |
| 2,869,907 | 1/1959 | Deliso . | |
| 2,924,312 | 2/1960 | Williams . | |
| 2,937,690 | 5/1960 | Hedstrom . | |
| 3,052,956 | 9/1962 | Daugherty . | |
| 3,068,508 | 12/1962 | Heyer . | |
| 3,084,003 | 4/1963 | Matt et al. . | |
| 3,300,850 | 1/1967 | Steuernagel . | |
| 3,332,473 | 7/1967 | Frederickson et al. . | |
| 3,418,012 | 12/1968 | Torre . | |
| 3,432,925 | 3/1969 | Woolley . | |
| 3,540,116 | 11/1970 | Drahos et al. . | |
| 3,599,318 | 8/1971 | Behlen . | |
| 3,629,930 | 12/1971 | Brumlik . | |
| 3,699,636 | 10/1972 | Walker . | |
| 3,726,000 | 4/1973 | Hafner . | |
| 3,728,779 | 4/1973 | Behlen et al. . | |
| 3,729,804 | 5/1973 | Middleton . | |
| 3,786,979 | 1/1974 | Muller . | |
| 3,871,264 | 3/1975 | Hallock . | |
| 3,872,578 | 3/1975 | Ullom . | |
| 3,882,264 | 5/1975 | Travis . | |
| 3,900,937 | 8/1975 | Schleicher . | |
| 3,902,237 | 9/1975 | Monson . | |
| 3,909,913 | 11/1975 | Tildesley . | |
| 3,921,803 | 11/1975 | Reed et al. | 29/515 X |
| 3,981,064 | 9/1976 | Hafner . | |
| 4,003,286 | 1/1977 | Hallock . | |
| 4,035,901 | 7/1977 | Lux et al. . | |

(List continued on next page.)

FOREIGN PATENT DOCUMENTS

| | | | |
|---|---|---|---|
| 2337599 | 9/1977 | France | 29/432.2 |

*Primary Examiner*—Peter Vo
*Assistant Examiner*—Khan Nguyen
*Attorney, Agent, or Firm*—Wood, Phillips, VanSanten, Clark & Mortimer

[57] ABSTRACT

A method of joining first and second sheets of deformable material by providing a first sheet having oppositely facing first and second surfaces, providing a second sheet having oppositely facing third and fourth surfaces, placing the second surface on the first sheet facially against the third surface on the second sheet, directing a first discrete element against the first sheet in a first direction to cause a part of the first sheet contacted by the first discrete element to deform and project beyond the fourth surface on the second sheet and directing a second discrete element against at least one of the first and second sheets to at least one of a) cause the part of the first sheet to deform transversely to the first direction to define a first shoulder facing oppositely to the first direction that abuts to the fourth surface and b) cause the second sheet to deform transversely to the first direction to define a second shoulder facing in the first direction that abuts to the part of the first sheet.

23 Claims, 2 Drawing Sheets

OTHER PUBLICATIONS 4,059,897 11/1977 Marquis .
4,106,179 8/1978 Bleckmann .
4,107,892 8/1978 Bellem .
4,122,641 10/1978 Bard et al. .
4,148,124 4/1979 Goniwicha .
4,173,915 11/1979 Gross .
4,231,145 11/1980 Dahle et al. .
4,306,511 12/1981 Ashby et al. .
4,367,578 1/1983 Johnson et al. .
4,376,333 3/1983 Kanamaru et al. .
4,391,037 6/1983 Giasini .
4,394,793 7/1983 Pav et al. .
4,397,224 8/1983 Walker .
4,449,294 5/1984 Gunter .
4,760,634 8/1988 Rapp ..... 29/521 X
4,835,850 6/1989 Eckold et al. ..... 29/521 X FIG. 3
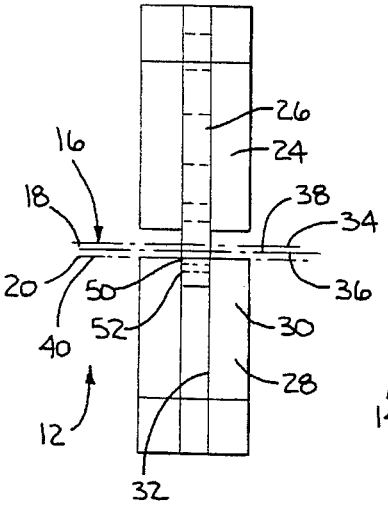
FIG. 4
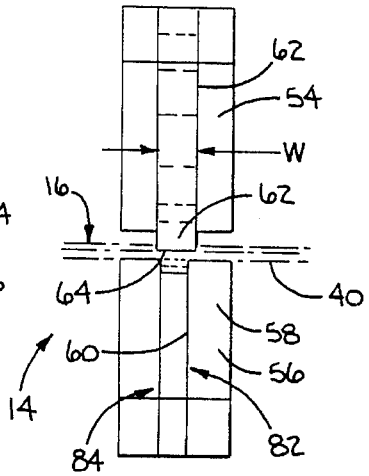
FIG. 5
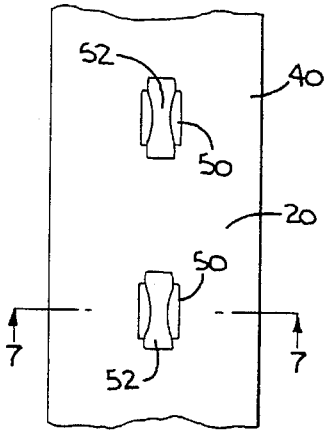
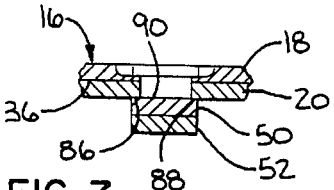
FIG. 7
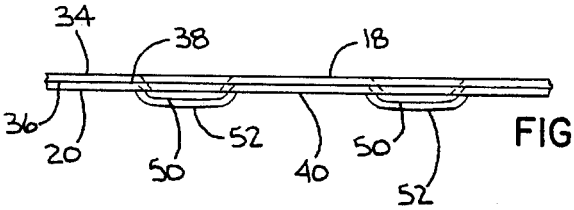
FIG. 6
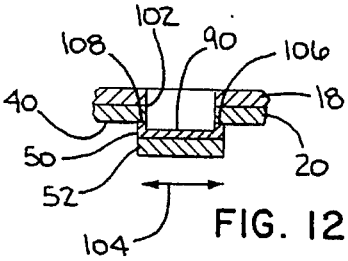
FIG. 12
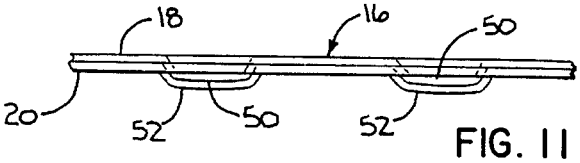
FIG. 11
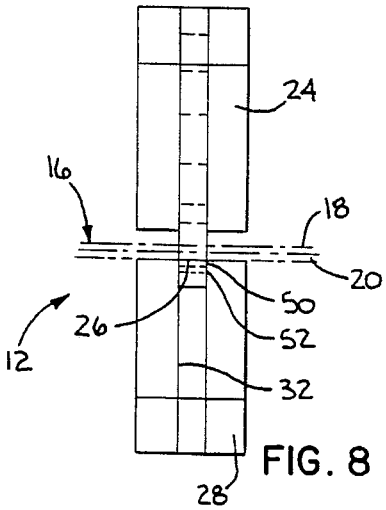
FIG. 8
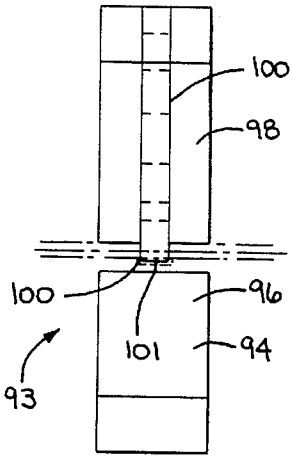
FIG. 9
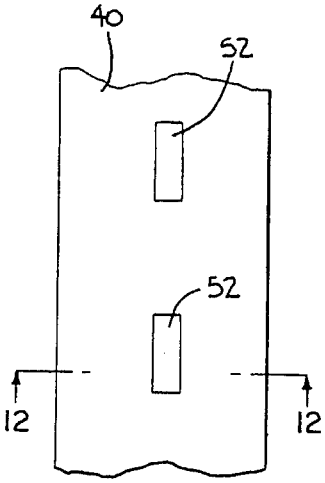
FIG. 10

METHOD AND APPARATUS FOR JOINING DEFORMABLE SHEET STOCK

BACKGROUND OF THE INVENTION

1. Field of the Invention

This invention relates to apparatus for joining overlapped metal sheets and, more particularly, to an apparatus for continuously deforming the sheets so as to resist separation of the sheets when subjected to shear and peeling forces. The invention is also directed to a method of joining the sheets, as with the inventive apparatus.

2. Background Art

It is well known to join lapped sheets of metal by deformation thereof, thereby obviating the need to weld or use separate fasteners, such as rivets, to effect joining. This process is commonly referred to in the trade as "metal stitching".

Metal stitching is commonly carried out on a reciprocating press. An exemplary system is currently offered by BTM Corporation of Marysville, Mich. The system employs a punch and die pair which permit a "stitch" to be formed with a single stroke of the punch.

The die is constructed to assume two different states. In the first state, the die defines a blind receptacle into which the sheet material can be drawn as the punch advances in a first line. At a predetermined point in the punch stroke, after the underlying sheet is lanced, the die spreads under pressure transversely to the line of the punch stroke to allow the drawn part of the overlying sheet to expand transversely to the line of the punch stroke. This causes the undeformed part of the underlying sheet to be sandwiched between the undeformed part of the overlying sheet and the dram part of the overlying sheet that is expanded transversely to the first line to under the second sheet.

While this type of system creates an effective "stitch", such systems are impractical for high volume "stitching". The operator thereof is required to serially align the sheets, extend the punch, retract the punch, and thereafter shift the sheet metal stock to repeat the "stitching" operation on a downstream portion of the stock. Such a system inherently requires either a substantial amount of operator involvement or an automated system that performs the "stitching" operation in somewhat inefficient steps.

Further, the requirement of using a die with movable parts makes the die more prone to failure than a fixed configuration die. At the same time, the more intricate, reconfigurable die may be more expensive to manufacture than a fixed configuration die.

SUMMARY OF THE INVENTION

The invention contemplates a method of joining first and second sheets of deformable material by providing a first sheet having oppositely facing first and second surfaces, providing a second sheet having oppositely facing third and fourth surfaces, placing the second surface on the first sheet facially against the third surface on the second sheet, directing a first discrete element against the first sheet in a first direction to cause a part of the first sheet contacted by the first discrete element to deform and project beyond the fourth surface on the second sheet and directing a second discrete element against at least one of the first and second sheets to at least one of a) cause the part of the first sheet to deform transversely to the first direction to define a first shoulder facing oppositely to the first direction that abuts to the fourth surface and b) cause the second sheet to deform transversely to the first direction to define a second shoulder facing in the first direction that abuts to the part of the first sheet.

The method may include the step of providing first and second rotary elements with the first discrete element on the first rotary element and the second discrete element on the second rotary element and rotating the first and second rotary elements to sequentially direct the first discrete element against the first sheet and the second discrete element against the at least one of the first and second sheets.

The first and second sheets of deformable material may be advanced in a conveying direction through rotation of the rotary element.

The method may include the steps of providing a plurality of the first discrete elements on the first rotary element and a plurality of the second discrete elements on the second rotary element so that a plurality of the first discrete elements are directed against the first sheet and a plurality of the second discrete elements are directed against at least one of the first and second sheets for each revolution of the first and second rotary elements.

A rotary drive element may be provided and used to directly drive the first and second rotary elements about spaced, substantially parallel axes.

A first rotary backing element may be provided with a first peripheral backing surface and a first peripheral undercut. The step of directing the first discrete element against the first sheet may involve the step of directing the first discrete element against the first sheet so that the part of the first sheet moves into the first peripheral undercut in the first rotary backing element with the fourth surface on the second sheet abutted to the first peripheral backing surface.

The step of directing the first discrete element against the first sheet may involve the step of causing a part of the second sheet to be deformed in the first direction by the part of the first sheet. A second rotary backing element with a peripheral backing surface may be provided so that the second discrete element can be directed against the at least one of the first and second sheets with the part of the second sheet abutted to the peripheral backing surface on the second rotary backing element.

The second rotary backing element may have a peripheral backing surface and a peripheral undercut, wherein the step of directing the second discrete element against the at least one of the first and second sheets involves the step of directing the second discrete element against the at least one of the first and second sheets with the pan of the second sheet at least partially within the peripheral undercut in the second rotary backing element.

The step of directing the second discrete element against the at least one of the first and second sheets may involve the step of directing the second discrete element against the at least one of the first and second sheets with the fourth surface on the second sheet abutted to the peripheral backing surface on the second rotary backing element.

The step of directing the first discrete element against the first sheet may involve the step of directing the first discrete element against the first sheet in the first direction so that at least one of the first and second sheets is lanced.

The step of directing the second discrete element against the at least one of the first and second sheets may involve the step of directing the second discrete element against the at least one of the first and second sheets to cause a part of the second sheet to deform transversely to the first direction.

The step of directing the second discrete element against the at least one of the first and second sheets may involve the step of directing the second discrete element against the at least one of the first and second sheets to cause other than the first part of the first sheet to deform transversely to the first direction.

The invention further contemplates a method of joining first and second sheets of deformable material by providing a first sheet having oppositely facing first and second surfaces, providing a second sheet having oppositely facing third and fourth surfaces, placing the second surface on the first sheet facially against the third surface on the second sheet, and progressively deforming at least one of the first and second sheets with first and second different discrete elements that are successively brought into contact with at least one of the first and second sheets so that one of the first and second sheets is captive between facing shoulders defined on the other of the first and second sheet.

The method may include the steps of providing the first discrete element on a first rotary element and the second discrete element on a second rotary element and rotating the first and second rotary elements so that the first discrete element deforms at least one of the first and second sheets and the second discrete element further deforms at least one of the first and second sheets.

The invention is further directed to an apparatus for joining a first sheet of deformable material having first and second oppositely facing surfaces with a second sheet of deformable material having third and fourth oppositely facing surfaces, with the second surface on the first sheet abutted to the third surface on the second sheet. The apparatus has a first structure for deforming a part of the first sheet in a first direction past the fourth surface of the second sheet and second structure for at least one of a) deforming the part of the first sheet transversely to the first direction to define a first shoulder facing oppositely to the first direction that abuts to the fourth surface and b) deforming a part of the second sheet transversely to the first direction to define a second shoulder facing in the first direction that abuts to the part of the first sheet.

The first structure may be a first rotary element having a first discrete element to engage the first surface on the first sheet and exert a force in the first direction that deforms the part of the first sheet. The second structure may include a second rotary element having a second discrete element to engage at least one of the first and second sheets to at least one of a) deform the part of the first sheet transversely to the first direction to define the first shoulder and b) deform a part of the second sheet transversely to the first direction to define the second shoulder.

A drive element may be provided, with there being structure cooperating between the drive element and each of the first and second rotary elements for effecting driving movement thereof.

In one form, the first rotary element has a peripheral surface with a plurality of first discrete elements thereon in equidistantly spaced relationship.

The second rotary element may have a peripheral surface with a plurality of second discrete elements thereon in equidistantly spaced relationship.

In one form, the apparatus includes a frame and the first structure includes a first backing element with a peripheral backing surface and a peripheral undercut, with the first rotary element and first backing element mounted to the frame for rotation so that the first discrete element moves into and out of the peripheral undercut.

The second structure may include a second backing element with a peripheral backing surface, with the second rotary element and second backing element mounted to the frame for rotation so that the second discrete element moves towards and away from a position adjacent to the peripheral backing surface.

The second structure may alternatively include a second backing element with a peripheral backing surface and a peripheral undercut so that with the second rotary element and second backing element mounted to the frame for rotation, the second discrete element moves into and out of the peripheral undercut.

Structure can be provided for driving the first and second sheets in a conveying direction so that the first structure and second structure serially act upon the conveying first and second sheets.

The invention also contemplates the above apparatus in combination with the first and second sheets.

The first structure may cause lancing of one of the first and second sheets.

The invention further contemplates an apparatus for joining a first sheet of deformable material having first and second oppositely facing surfaces with a second sheet of deformable material having third and fourth oppositely facing surfaces with the second surface on the first sheet abutted to the third surface on the second sheet. The apparatus has a first pair of cooperating rotary elements for deforming a part of at least one of the first and second sheets in a first manner. A second pair of cooperating rotary elements are provided to further deform at least one of the first and second sheets so that one of the first and second sheets is captive between facing shoulders on the other of the first and second sheets.

The apparatus may include structure for advancing the first and second sheets serially between the first pair of cooperating rotary elements and the second pair of cooperating rotary elements.

In one form, the first and second pairs of cooperating rotary elements effect the advancement of the first and second sheets.

The invention also contemplates the combination of the apparatus with first and second sheets of deformable material.

The invention still further contemplates an apparatus for joining a first sheet of deformable material having first and second oppositely facing surfaces with a second sheet of deformable material having third and fourth oppositely facing surfaces with the second surface on the first sheet abutted to the third surface on the second sheet. The apparatus includes rotary die structure for deforming at least one of the first and second sheets so that one of the first and second sheets is captive between facing shoulders defined on the other of the first and second sheets.

The invention contemplates the above structure in combination with the first and second sheets.

BRIEF DESCRIPTION OF THE DRAWINGS

FIG. 3 is a fragmentary end elevation view of a pair of cooperating, rotary elements on the inventive apparatus that effect deformation of advancing first and second sheets in a first manner;

FIG. 4 is an end elevation view of a pair of cooperating rotary elements that act on the first and second sheets downstream of the rotary elements in FIG. 3;

FIG. 5 is a fragmentary bottom view of first and second sheets joined using the inventive apparatus;

FIG. 6 is a side elevation view of the joined sheets in FIG. 5;

FIG. 7 is an enlarged, cross-sectional view of the joined sheets taken along line 7—7 of FIG. 5;

FIG. 8 is a fragmentary end elevation view of a pair of cooperating, rotary elements, in a modified form of the inventive apparatus, that effect deformation of the advancing first and second sheets in a first manner;

FIG. 9 is an end elevation view of a pair of cooperating rotary elements that act on the first and second sheets downstream of the rotary elements in FIG. 8;

FIG. 10 is a fragmentary bottom view of first and second sheets joined using the apparatus in FIGS. 8 and 9;

FIG. 11 is a side elevation view of the joined sheets in FIG. 10; and

FIG. 12 is an enlarged, cross-sectional view of the joined sheets taken along line 12—12 of FIG. 10

DETAILED DESCRIPTION OF THE DRAWINGS

Figure 1:
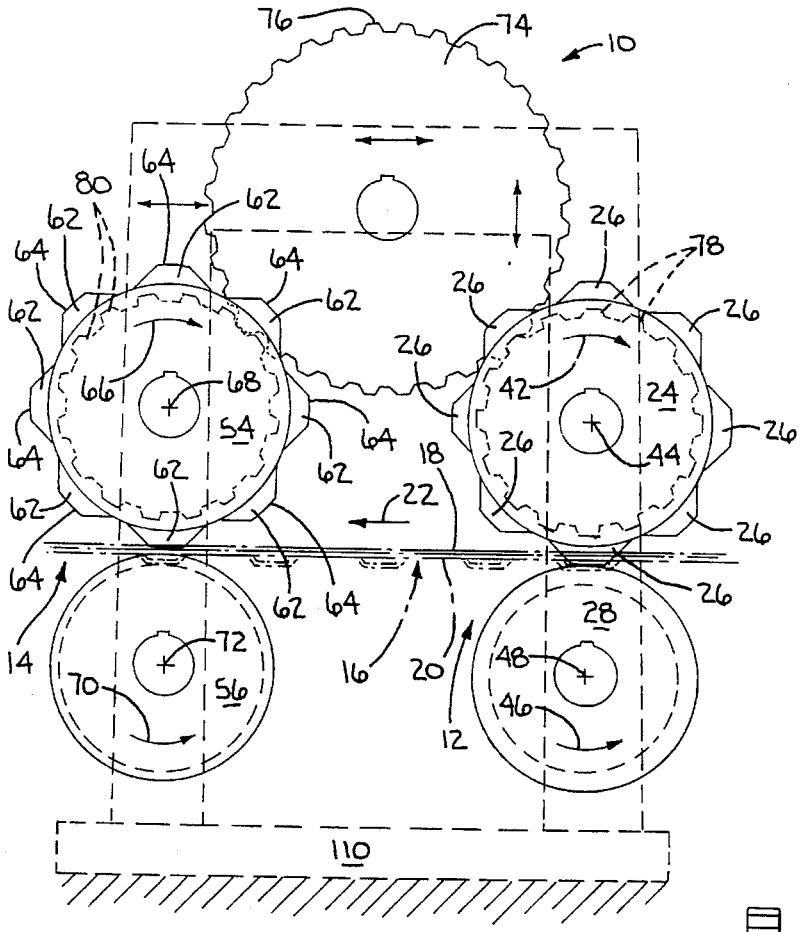
FIG. 1 is a side elevation view of an apparatus for joining first and second sheets of deformable material, according to the present invention.
Figure 2:
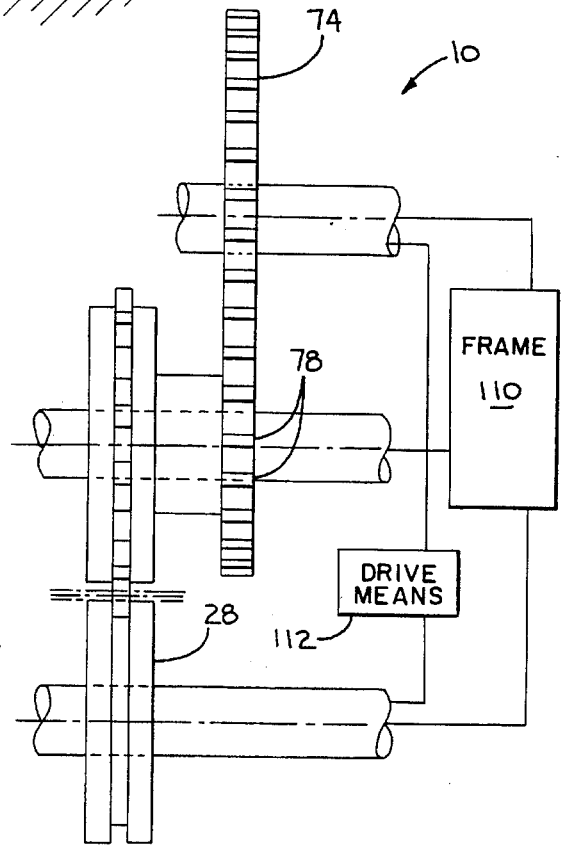
FIG. 2 is an end elevation view of the inventive apparatus in FIG. 1.

In FIGS. 1 and 2, an apparatus for joining multiple sheets of deformable material, according to the present invention, is shown at 10. Briefly, the apparatus 10 has a first rotary die set 12 and a second rotary die set 14, downstream of the first die set 12, for serially forming a composite web at 16 consisting of a first, overlying sheet 18 of deformable material and a second, underlying sheet 20 of deformable material. As explained in greater detail below, the composite web 16 is advanced through the apparatus 10 in the direction of the arrow 22, whereupon the first die set 12 deforms the sheets 18, 20 in a first manner and the second die set 14 deforms the web 16 in a second manner so as to lock the sheets 18, 20 firmly against separation by both peeling and shear forces.

Two different manners of "stitching" the metal sheets 18, 20 according to the invention are shown in the drawings. The first manner is shown in FIGS. 1–7, with the second manner shown in FIGS. 8–12, taken in conjunction with FIGS. 1 and 2.

Referring initially to FIGS. 1–7, the first die set 12 includes a first rotary element 24 that has a plurality of discrete forming elements 26 spaced equidistantly around the periphery thereof.

The first rotary element 24 cooperates with a rotary backing element 28 that has a peripheral backing surface 30 and a peripheral undercut 32.

The web 16 is arranged so that a first surface 34 on the first sheet 18 faces upwardly and an oppositely facing second surface 36 on the first sheet 18 facially abuts an upwardly facing third surface 38 on the second sheet 20. An oppositely facing fourth surface 40 on the second sheet 20 faces downwardly. The web 16 is advanced in the direction of the arrow 22 between the elements 24, 28, which cooperate to convey the web 16, as does the downstream die set 14.

As described in greater detail below, the element 24 is driven in the direction of the arrow 42 about an axis 44 while the element 28 is driven in the direction of the arrow 46 about an axis 48, that is parallel to the axis 44.

The bottom surface 40 on the second sheet 20 abuts to the peripheral backing surface 30. As the elements 24, 28 rotate, the discrete elements 26 move consecutively in and out of the peripheral undercut 32 so as to draw parts 50, 52 of the first and second sheets 18, 20, respectively, radially into the undercut 32. As this occurs, both of the sheets 18, 20 are lanced. The parts 50, 52 are drawn sufficiently that the part 50 of the first sheet projects beyond the fourth surface 40 of the undeformed part of the second sheet 20. The discrete elements 26 move into and out of the undercut 32 to deform the web 16 as just described in regular intervals therealong.

The web 16 continues conveying from the die set 12 to the die set 14, which includes a rotary element 54 and a rotary backing element 56. The backing element 56 has a peripheral backing surface 58 and a peripheral undercut 60 to accommodate the web in the configuration as deformed by the first die set 12. That is, the undercut 60 is aligned with the undercut 32 so that the conveying web 16 moves between the elements 54, 56 with the fourth surface 40 on the second sheet 20 abutted to the peripheral surface 58 and the parts 50, 52 in the undercut 60.

The rotary element 54 has discrete elements 62 thereon, which are spaced equidistantly around the periphery of the rotary element 54. The elements 62 have an outer swaging surface 64 with a width W that is larger than the width of the undercut 60.

The rotary element 54 is rotated in the direction of arrow 66 about the axis 68 while the backing element 56 is rotated in the direction of the arrow 70 around an axis 72 that is parallel to the axis 68. The rotary elements 24, 54 are directly driven by a drive wheel 74 having peripheral teeth 76 that mesh between teeth 78 on the element 24 and teeth 80 on the element 54. Through this arrangement, precise registration between the elements 24, 54 can be maintained so that the elements 62 contact the web 16 at precisely the same location as the web 16 is contacted by the elements 26.

As the web 18 advances between the elements 54, 56, the elements 62 act against the first sheet 18 and apply a radial compressive force thereupon. Since the elements 62 are wider than the undercut 60, the surface 64 on the element 62 bridges the undercut 60 and compresses the web 16 against the peripheral surface 58 at both axial ends 82, 84 of the undercut 60. As seen most clearly in FIG. 7, this action causes the first and second sheets 18, 20 above the deformed parts 50, 52 to deform inwardly i.e. transversely to the length of the web 16, to thereby define spaced shoulders 86, 88 on the second sheet 20 which face and abut to the upwardly facing surface 90 on the part 50 that was drawn out of the first sheet 18 by the first die set 12. With this arrangement, the second sheet 20 is held firmly captive between the surface 90 on the first sheet part 50 and the second surface 36 on the first sheet 18.

The second manner of "stitching" the composite web 16 is shown in FIGS. 8–12. The same first die set 12 is used in the same manner to draw the first and second peals 50, 52 of the first sheet 18 and second sheet 20 into the undercut 32 on the backing element 28.

Thereafter, a second die set 93 is used in place of the die set 14 downstream of the die set 12. The die set 93 includes a rotary backing element 94 with a peripheral surface 96 thereon.

The backing element 94 cooperates with a rotary element 98 which has teeth 100 spaced equidistantly around the periphery thereof. The teeth 100 have an outermost surface 101 which moves radially through the void 102 created by the drawing of the first sheet 18 and second sheet 20 by the elements 26 on the rotary element 24. The surface 101 acts against the upper surface 90 of the sheet part 50, exerting a radial force thereon towards the peripheral surface 96 on the backing element 94, because backing element 94 has no peripheral undercut, the sheet part 50 is radially compressed against the peripheral surface 96. This compression results in these sheet parts 50, 52 expanding outwardly in the direction of the double-headed arrow 104, i.e. transversely to the length of the web 16, with the result being that shoulders 106, 108 are defined on the sheet part 50, which shoulders 106, 108 confront the fourth surface 40 on the second sheet 20 to thereby prevent separation of the sheets 18, 20, each from the other. That is, the second sheet 20 becomes captive between an undeformed portion of the first sheet 18 and the sheet part 50. The sheets 18, 20, joined as shown in FIGS. 8–12, have the same integrity of connection as do the sheets 18, 20, joined as described with respect to FIGS. 3–7.

Each of the die sets 12, 14, 93 and drive wheel 74 is mounted to a common frame 110. The drive means 112 imparts rotational movement to the drive wheel 74, which in turn drives the rotary elements 24, 54, and the backing elements 28, 56, 94.

With the inventive structure, it is possible to continuously "stitch" a running web 16. It is possible with existing technology to continuously "stitch" the composite web with the apparatus running at least as high as 300 feet per minute.

The foregoing disclosure of specific embodiments is intended to be illustrative of the broad concepts comprehended by the invention.

We claim:

1. A method of joining first and second sheets of deform able material, said method comprising the steps of:

providing a first sheet having oppositely facing first and second surfaces;

providing a second sheet having oppositely facing third and fourth surfaces;

placing the second surface on the first sheet facially against the third surface on the second sheet;

directing a first discrete element against the first sheet at a first location to cause a part of the first sheet contacted by the first discrete element to be deformed to project through and beyond the fourth surface on the second sheet;

moving the first discrete element relatively away from the first sheet at the first location; and directing a second discrete clement to compress against at least one of the first and second sheets at the first location to at least one of a) cause the part of the first sheet to deform so as to define a first shoulder facing oppositely to the fourth surface that abuts to the fourth surface and b) cause the second sheet to deform so as to define a second shoulder that faces and abuts to the part of the first sheet.

2. The method of joining first and second sheets of deformable material according to claim 1 wherein the step of directing the first discrete elements against the first sheet comprises the step of directing the first discrete element against the first sheet so that at least one of the first and second sheets is lanced.

3. A method of joining first and second sheets of deformable material, said method comprising the steps of:

providing a first sheet having oppositely facing first and second surfaces;

providing a second sheet having oppositely facing third and fourth surfaces;

placing the second surface on the first sheet facially against the third surface on the second sheet;

providing first and second rotary elements with the first discrete element on the first rotary element and the second discrete element on the second rotary element;

rotating the first and second rotary elements to sequentially direct the first discrete element against the first sheet in a first direction to cause a part of the first sheet contacted by the first discrete element to be deformed to project beyond the fourth surface on the second sheet;

directing the second discrete element against at least one of the first and second sheets to at least one of a) cause the part of the first sheet to deform transversely to the first direction to define a first shoulder facing oppositely to the first direction that abuts to the fourth surface and b) cause the second sheet to deform transversely to the first direction to define a second shoulder facing in the first direction that abuts to the part of the first sheet.

4. The method of joining first and second sheets of deformable material according to claim 3 including the step of advancing the first and second sheets of deformable material in a conveying direction through rotation of the rotary elements.

5. The method of joining first and second sheets of defrayable material according to claim 3 including the steps of providing a plurality of the first discrete elements on the first rotary element and a plurality of the second discrete elements on the second rotary element so that a plurality of the first discrete elements are directed against the first sheet and a plurality of the second discrete elements are directed against the at least one of the first and second sheets for each revolution of the first and second rotary elements.

6. The method of joining first and second sheets of deformable material according to claim 3 including the steps of providing a rotary drive element and directly driving the first and second rotary elements about spaced, substantially parallel axes through the rotary drive element.

7. The method of joining first and second sheets of deformable material according to claim 3 including the step of providing a first rotary backing element with a first peripheral backing surface and a first peripheral undercut and wherein the step of directing the first discrete element against the first sheet comprises the step of directing the first discrete element against the first sheet so that the part of the first sheet moves into the peripheral undercut on the first rotary backing element with the fourth surface on the second sheet abutted to the first peripheral backing surface.

8. The method of joining first and second sheets of deformable material according to claim 3 wherein the step of directing the first discrete element against the first sheet comprises the step of causing a part of the second sheet to be deformed in the first direction by the part of the first sheet and including the step of providing a second rotary backing element with a peripheral backing surface and wherein the step of directing the second discrete element against the at least one of the first and second sheets comprises the step of directing the second discrete element against the at least one of the first and second sheets with the part of the second sheet abutted to the peripheral backing surface on the second rotary backing element.

9. The method of joining first and second sheets of deformable material according to claim 3 wherein the step of directing the first discrete element against the first sheet comprises the step of causing a part of the second sheet to be deformed in the first direction by the part of the first sheet and including the step of providing a second rotary backing element with a peripheral backing surface and a peripheral undercut and wherein the step of directing the second discrete element against the at least one of the first and second sheets comprises the step of directing the second discrete element against the at least one of the first and second sheets with the pail of the second sheet at least partially within the peripheral undercut in the second rotary backing element.

10. The method of joining first and second sheets of deformable material according to claim 9 wherein the step of directing the second discrete element against the at least one of the first and second sheets comprises the step of directing the second discrete element against the at least one of the first and second sheets with the fourth surface on the second sheet abutted to the peripheral backing surface on the second rotary backing element.

11. A method of joining first and second sheets of deformable material, said method comprising the steps of:

providing a first sheet having first and second substantially flat surfaces, said first surface facing in a first direction and said second sheets facing in a second direction that is opposite to the first direction;

providing a second sheet having oppositely facing third and fourth surfaces;

placing the second surface on the first sheet facially against the third surface on the second sheet; and progressively deforming at least one of the first and second sheets with first and second different discrete elements that are successively brought into contact with at least one of the first and second sheets at the same location on the at least one of the first and second sheets so that one of the first and second sheets becomes captive between spaced facing first and second surfaces defined on the other of the first and second sheets, said first surface facing in one of the first and second directions and the second surface facing in the other of the first and second directions.

12. The method of joining first and second sheets of deformable material according to claim 11 including the steps of providing the first discrete element on a first rotary element and the second discrete element on a second rotary element and rotating the first and second rotary elements so that the first discrete element defines at least one of the first and second sheets and the second discrete elements further deforms at least one of the first and second sheets.

13. An apparatus for joining a first sheet of deformable material having first and second oppositely facing surfaces with a second sheet of deformable material having third and fourth oppositely facing surfaces with the second surface on the first sheet abutted to the third surface on the second sheet, said apparatus comprising:

first means for deforming a part of the first sheet in a first direction past the fourth surface of the second sheet, wherein the first means comprises a first rotary element having a first discrete element to engage the first surface on the first sheet and exert a force in the first direction that deforms the part of the first sheet; and second means comprising a second rotary element having a second discrete element to engage at least one of the first and second sheets to at least one of (a) deform a part of the first sheet transversely to the first direction at the deformed part of the first sheet to define the first shoulder and (b) deform a part of the second sheet transversely to the first direction at the deformed part of the first sheet to define a second shoulder.

14. The apparatus for joining a first sheet of deformable material with a second sheet of deformable material according to claim 13 including a drive element, means cooperating between the drive element and first rotary element for driving the first rotor element and means cooperating between the drive element and second rotary element for driving the second rotary element.

15. The apparatus for joining a first sheet of deformable material with a second sheet of deformable material according to claim 13 wherein the first rotary element has a peripheral surface with a plurality of first discrete elements thereon in equidistantly spaced relationship.

16. The apparatus for joining a first sheet of deformable material with a second sheet of deformable material according to claim 15 wherein the second rotary element has a peripheral surface with a plurality of second discrete elements thereon in equidistantly spaced relationship.

17. The apparatus for joining a first sheet of deformable material with a second sheet of deformable material according to claim 13 wherein the apparatus includes a frame, the first means includes a first backing element with a peripheral backing surface and a peripheral undercut and there are means for mounting the first rotary element and first backing element of the frame for rotation so that the first discrete element moves into and out of the peripheral undercut.

18. The apparatus for joining a first sheet of deformable material with a second sheet of deformable material according to claim 13 wherein the apparatus includes a frame, the second means includes a second backing element with a peripheral backing surface and there are means for mounting the second rotary element and second backing element to the frame for rotation so that the second discrete element moves towards and away from a position adjacent to the peripheral backing surface.

19. The apparatus for joining a first sheet of deformable material with a second sheet of deformable material according to claim 13 wherein the apparatus includes a frame, the second means includes a second backing element with a peripheral backing surface and a peripheral undercut and there are means for mounting the second rotary element and second backing element of the frame for rotation so that the second discrete element moves into and out of the peripheral undercut.

20. An apparats for joining a first sheet of deformable material having first and second oppositely facing surfaces with a second sheet of deformable material having third and fourth oppositely facing surfaces with the second surface on the first sheet abutted to the third surface on the second sheet, said apparatus comprising:

a first pair of cooperating rotary elements having means for deforming a part of at least one of the first and second sheets at a first location in a first manner;

a second pair of cooperating rotary elements having means to deform at least one of the first and second sheets at the first location in such a manner that one of the first and second sheets becomes captive between facing surfaces on the other of the first and second sheets.

21. The apparatus for joining a first sheet of deformable material with a second sheet of deformable material according to claim 20 including means for advancing first and second sheets of deformable material to be joined serially between the first pair of cooperating rotary elements and the second pair of cooperating rotary elements.

22. The apparatus for joining a first sheet of deformable material with a second sheet of deformable material according to claim 21 wherein the means for serially advancing the first and second sheets comprises at least one of the first and second pairs of cooperating rotary elements.

23. The apparatus for joining a first sheet of deformable material with a second sheet of deformable material according to claim 20 in combination with the first and second sheets of deformable material.

* * * * *